US005687247A

United States Patent [19]

Proni

[11] Patent Number: 5,687,247

[45] Date of Patent: Nov. 11, 1997

[54] SURROUND FOR A LOUDSPEAKER

[76] Inventor: Lucio Proni, 1710 SW. 87th Ave., Miramar, Fla. 33025

[21] Appl. No.: 501,902

[22] Filed: Jul. 13, 1995

[51] Int. Cl.[6] ..... H04R 25/00

[52] U.S. Cl. ..... 381/193; 381/197; 381/204; 181/171

[58] Field of Search ..... 381/193, 197, 381/199, 194, 188, 205; 181/171, 172

[56] References Cited

U.S. PATENT DOCUMENTS

| | | |
|---|---|---|
| 3,072,213 | 1/1963 | Petrie . |
| 3,892,289 | 7/1975 | Rollins . |
| 3,997,023 | 12/1976 | White . |
| 4,122,314 | 10/1978 | Matsuda et al. . |
| 4,190,746 | 2/1980 | Harwood et al. . |
| 4,206,832 | 6/1980 | Yocum . |
| 4,234,766 | 11/1980 | Cacho . |
| 4,235,302 | 11/1980 | Tsukamoto . |
| 4,384,174 | 5/1983 | Suzuki et al. . |
| 4,582,163 | 4/1986 | Catthoor . |
| 5,099,949 | 3/1992 | Mitobe . |
| 5,111,510 | 5/1992 | Mitobe . |
| 5,115,474 | 5/1992 | Tsuchiya et al. . |
| 5,243,151 | 9/1993 | Prokisch . |
| 5,371,805 | 12/1994 | Saiki et al. . |

*Primary Examiner*—Sinh Tran
*Attorney, Agent, or Firm*—Malin, Haley, DiMaggio & Crosby, P.A.

[57] ABSTRACT

An improved surround design for a loudspeaker assembly is disclosed wherein the outside edge of the surround is attached to the outer edge of the loudspeaker's frame via a permanent or removable means. When removably attached, access to the mounting holes of the loudspeaker frame is accomplished by moving the roll to one side, prior to the attachment of the securing means. The method of attachment can vary, and in several embodiments includes the use of a annular o-ring, while in another attaching embodiment the use of a locking finger is provided. In one embodiment, a removable spider is also provided, thus allowing the front end of the loudspeaker to be replaced for repair or reconfiguration purposes.

9 Claims, 9 Drawing Sheets

SURROUND FOR A LOUDSPEAKER

BACKGROUND OF THE INVENTION

1. Field of the Invention

The present invention relates generally to the field of loudspeakers and in more particular to an improved outer-suspension design for a loudspeaker.

2. Description of the Prior Art

In the design of loudspeakers, the suspension system in any loudspeaker is normally comprised of two elements, the surround (front or outer suspension) and the spider (rear suspension). The surround is the mechanical device which holds the outer edge of the diaphragm/cone of the loudspeaker. Often the word "roll" is used in place of "surround" when describing the front suspension. Surrounds can be constructed from several materials including rubber, compressed foam rubber, corrugated cloth, paper, plastic, etc. Roll surrounds have a single, large, semi-circular corrugation typically constructed from rubber, compressed foam rubber or treated fabric.

Surrounds help keep the cone centered and provide a portion of the restoring force that keeps the voice coil in the gap created between the pole piece and top plate of the loudspeaker. The surround also provides a damped termination for the edge of the cone. The choice of thickness and material type for surround construction can greatly alter the response of the loudspeaker.

The spider, commonly constructed from treated corrugated fabric, also keeps the voice coil concentric to the pole piece, as well as providing a portion of the restoring force that maintains the voice coil within the gap. The stiffness of the spider can greatly affect the loudspeaker's resonance. The spider also provides a barrier for keeping foreign particles away from the gap area.

Surrounds are one of the primary limiting factors in designing long-excursion loudspeakers. Excursion is defined as the amount of linear length the cone body can travel. With the conventional small roll diameters currently in use, the excursion is often limited by the surround's physical limits. Larger surrounds cannot be used without an attendant loss in effective cone area for a loudspeaker of given outside diameter, thus, creating an inevitable trade-off. Excursion and cone area are the two factors which contribute to a loudspeaker's volume displacement. The higher the volume displacement capability of a loudspeaker, the greater the loudspeaker's ultimate low frequency output potential can be.

In addition to controlling the linear motion of the cone, the surround also acts as a major centering force for the loudspeaker's voice coil. This centering force prevents the voice coil and former from rocking and rubbing against the pole piece or top plate.

Presently, the surround is typically glued to the inner top edge of a flat extension or rim on the outside of the loudspeaker's frame, which also acts as the loudspeaker's mounting flange. With such assembly method, a significant amount of cone area is sacrificed, relative to the loudspeaker's overall footprint (outside diameter). The cone area is a major contributing factor to a loudspeaker's output and efficiency. The sacrifice in cone area is seen as a necessary evil because of the need to provide an accessible mounting flange for the loudspeaker.

Furthermore, current methods for replacing moving parts of a cone loudspeaker, for the purpose of repair, require special skill, tools and adhesives. Typically, the moving parts are cut away and the loudspeaker frame and motor structure (magnet and metal parts that complete the magnetic circuit) are stripped down with chemicals or hand scraped to remove adhesive residue. Once the frame is stripped, new moving parts must be glued together, aligned carefully and glued to the loudspeaker frame. This repair or replacement assembly process normally is handled by trained loudspeaker technicians and requires specialized gauges or alignment spacers for each loudspeaker, as well as a high degree of precision in order to be successful.

Some current small dome loudspeakers, primarily tweeters, and compression drivers feature the ability to quickly remove and replace their moving parts. This is facilitated greatly in these designs due to the lack of a rear suspension or spider. In these designs, the diaphragm, voice coil and surround are typically attached to a rigid frame which bolts or screws to the top plate of the loudspeaker. The frame is usually located with holes which line up to pegs on the motor structure for alignment. In such designs, the loudspeaker must be removed from its mounting location to perform the repair.

One product currently on the market, provides a woofer in which the motor structure (i.e. magnet, back plate, pole piece and top plate) is removed from the frame so that the voice coil can be inspected. However, the moving parts (roll, cone body, dust cap, voice coil and spider) remain attached to the loudspeaker's frame. Another product on the market, provides a cone loudspeaker which features a screw-down spacer between its dual spiders or rear suspensions. The spacer screws through the frame to the top plate of the loudspeaker. The screws do not provide the necessary physical constraints to align the voice coil within the magnetic gap. This is still done with gauges (alignment spacers). The surround is glued to the frame in a conventional manner and the spider is glued to the spacer. Accordingly, this product fails to provide for easy field replacement of its parts.

Additionally, a loudspeaker must be carefully optimized for its intended task. Changes in its moving mass, motor strength, voice coil winding length/gauge/thickness or suspension compliance radically affect the performance of the loudspeaker. There are inevitable tradeoffs in the process of loudspeaker design. These tradeoffs must be carefully balanced with the intended task of the loudspeaker in mind, i.e. concert sound reinforcement, automotive sub-bass, home-theater, etc. With woofers, the intended enclosure type affects the design of the driver as well.

Ideally, an end user chooses a loudspeaker which will work best in his or her intended application. The most expensive components of a loudspeaker are its non-moving parts, which generally include the loudspeaker frame, and the motor structure. The moving parts of the loudspeaker generally represent a smaller portion of the total cost of the loudspeaker. If the user's operating conditions change, the loudspeaker may no longer be well-suited and is likely to be replaced with a more appropriate loudspeaker. Such is the case even if there is nothing wrong with the original loudspeaker and usually amounts to a relatively significant expenditure each time the operating conditions change.

Some existing small dome loudspeakers, primarily tweeters, and compression drivers feature the ability to remove and replace their moving parts, in the event of failure. Different impedance diaphragms are offered that will work in the same motor structure. The basic mission of the loudspeaker is not changed, only the load presented to the amplifier. However, the prior art fails to provide for reconfiguring the same motor structure in the field for different applications and enclosure types, specifically for low frequency woofers.

Additionally, the prior art fails to provide for a loudspeaker design which provides for relatively quick field replacement of the moving parts of a cone type loudspeaker, and in more particular to cone type loudspeakers which feature a rear suspension or spider in addition to the surround. The prior art also fails to provide a surround which is attached to the outer edge of the loudspeaker frame for improved overall displacement capability. Furthermore, the prior art fails to provide for a removable surround. It is therefore, to the effective resolution of the aforementioned problems and shortcomings of the prior art that the present invention is directed.

SUMMARY OF THE INVENTION

The present invention provides an improved surround design for a loudspeaker assembly wherein the outside edge of the surround is attached to the outer edge of the loudspeaker's frame via a fixed or removable means. When removably attached, access to the mounting holes of the loudspeaker frame is accomplished or provided by moving the roll to one side, prior to the attachment of the securing means. The method of attachment can vary, and in several embodiments includes the use of an annular o-ring, while in another attaching embodiment the use of a locking finger is provided.

The present invention provides for the improvement of overall displacement capability of the loudspeaker by allowing the use of the space typically reserved only for the loudspeaker's mounting flange for larger or oversized surrounds and/or greater cone area. The present invention allows for increased cone displacement for any given loudspeaker diameter. Thus, for a given outside loudspeaker diameter and a given effective cone area, the present invention permits the use of a surround with a much larger cross-sectional diameter, as compared to conventional designs. Because of the increased displacement capability, the present invention allows for the design of long-excursion loudspeakers which can outperform conventional loudspeakers of equal outside diameters using conventional surrounds.

The larger rolls or surrounds also permit longer excursion, as compared to smaller rolls, with a lesser degree of roll deformation for a given excursion. Under high-excursion demands the larger rolls also provide a more consistent compliance and better cone centering ability.

By moving the outer attachment point of the roll to the outside of the loudspeaker frame, a larger effective cone area is achieved for a given frame diameter (outside diameter). Thus, the design of smaller outside diameter loudspeakers with equal effective cone area as larger outside diameter conventional loudspeakers can be provided, without sacrificing the surround's roll diameter, which would affect the excursion capability. Furthermore, the present invention also permits increases in both cone area and excursion capability by providing a larger roll and larger cone area for a given frame diameter (outside diameter).

Additionally, the present invention allows the surround's roll to enclose the loudspeaker's mounting holes, thus achieving an excellent enclosure seal. Any air leaks around the bolts/screws are not important, as they are still within the enclosure. The enclosure seal is important for the linear performance of enclosed low frequency systems. Also by enclosing the loudspeaker's mounting holes, the mounting screws are concealed which makes for a cleaner appearance.

By providing a removable attachment between the surround and loudspeaker frame, the present invention provides a method for quickly replacing the moving parts of a cone type loudspeaker, and in particular for loudspeakers which feature a rear suspension or spider in addition to the surround. To allow for the quick replacement feature of the present invention the following must be provided (1) a removable/replaceable surround to loudspeaker frame attachment; (2) a removable/replaceable spider to loudspeaker frame attachment which also ensures proper centering of the voice coil in the magnetic gap; and (3) a removable/replaceable electrical contact for the voice coil circuit.

The present invention allows for moving parts replacement which is achieved without the use of adhesives, thus, eliminating adhesive-curing time and adhesive shelf-life problems, as well as the environmental impact of adhesives. The moving parts can be replaced without removing the loudspeaker frame from its mounting surface or enclosure. Thus, field service is greatly facilitated resulting in substantial time savings. For example, during a musical performance, a failed loudspeaker could be repaired in a matter of seconds. Furthermore, the present invention allows for the servicing of loudspeakers by personnel having a modest amount of technical prowess and also allows the loudspeaker to be diagnosed without destroying the loudspeaker.

The present invention allows for reconfiguring a loudspeaker for different tasks or enclosure types by replacing the moving parts with a pre-engineered set of new moving parts better suited for the desired task. Such reconfiguration can be accomplished in the field without the need for specialized technicians, tools or adhesives. Thus, the user can optimize the loudspeaker for its intended use with the knowledge that the loudspeaker can be reconfigured for a minimal cost if the user's requirements change. Furthermore, the loudspeaker is easily upgraded to the latest specifications at a minimal cost, while retaining the existing loudspeaker frame and motor structure, as product improvements are made.

As stated above, the loudspeaker frame and motor structure generally constitute the most expensive components of the loudspeaker. With the present invention, these components are not replaced, as only the removal of the moving parts of the loudspeaker are required for reconfiguration. As the moving parts are relatively inexpensive as compared to the fixed parts of the loudspeaker, the present invention provides a cost effective method of upgrading a loudspeaker to meet a user's requirements. Furthermore, such upgrading or reconfiguration can take place in the field.

The present invention reduces waste and cost by allowing the same loudspeaker frame and motor structure to be reused over and over. Also, a dealer of loudspeakers can carry a wide range of performance options by stocking a nominal number of "back ends" (motor structures, loudspeaker frames), while keeping a wider variety of the relatively less expensive "front ends" (moving assemblies). Accordingly, the present allows a loudspeaker dealer to effectively stock a very extensive loudspeaker line at a much reduced cost.

Accordingly, it is an object of the present invention to provide an improved surround design for a loudspeaker wherein the overall displacement capability of the loudspeaker is improved.

It is another object of the present invention to provide an improved surround design for a loudspeaker which allows for increased cone displacement for any given loudspeaker diameter.

It is yet another object of the present invention to provide an improved surround design for a loudspeaker which allows for a longer excursion with a lesser degree of roll deformation for a given excursion.

It is still another object of the present invention to provide an improved surround design for a loudspeaker which provides a method for quickly replacing the moving parts of a cone type loudspeaker.

It is even still another object of the present invention to provide an improved surround design for a loudspeaker which allows for a loudspeaker to be properly repaired or serviced by personnel having a modest amount of technical skill in loudspeaker design or technology.

It is a further object of the present invention to provide an improved surround design for a loudspeaker which allows for reconfiguring of the same motor structure in the field for different applications and enclosure types.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1:
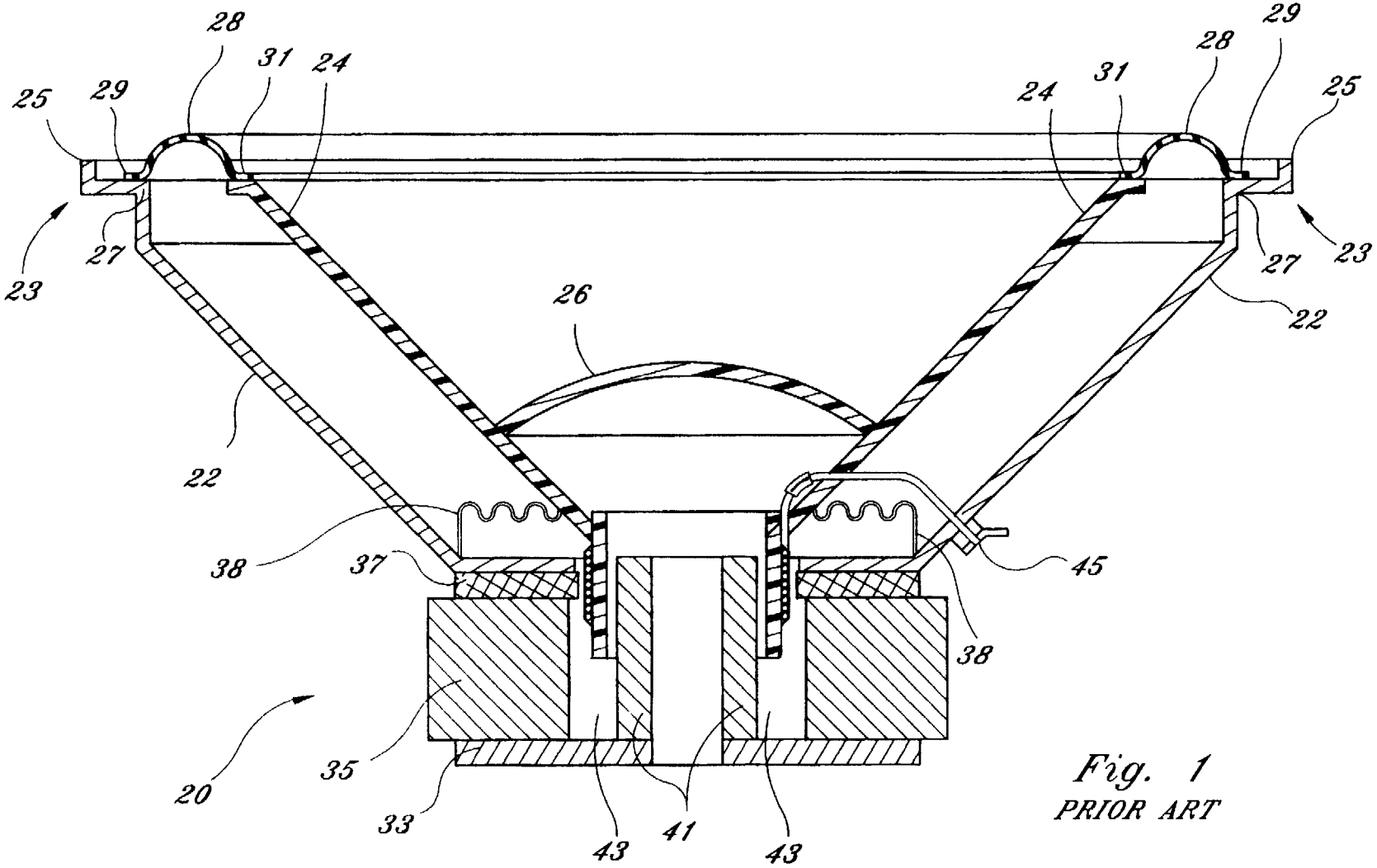
Fig. 1 PRIOR ART
FIG. 1 is a side view of a prior art loudspeaker system.

FIG. 1 illustrates a prior art loudspeaker generally designated as 20. Loudspeaker 20 includes a loudspeaker frame 22 having an outer mounting flange or rim 23. Mounting flange 23 includes an outside edge 25 and an inner edge 27. A front end suspension 28, commonly referred to as a "surround" or "roll", is shown attached to at its outside peripheral or edge 29 to inner peripheral or edge 27 of mounting flange 23. The inner edge 31 of annular surround 28 is shown attached cone diaphragm 24 at its outer peripheral. Surround 28 is attached to mounting flange 23 and cone 24 by conventional means in the industry such as the application of adhesives.

Loudspeaker 20 also includes a top plate 37, magnet 35, back plate 33, pole piece 41 and voice coil 43, as well as a spider 38. A magnetic gap is created between the inner edge of top plate 37 and pole piece 41. A dust cap 26, preferably is provided to prevent foreign particles from entering the gap area. Wiring 45 is also provided.

Figure 2:
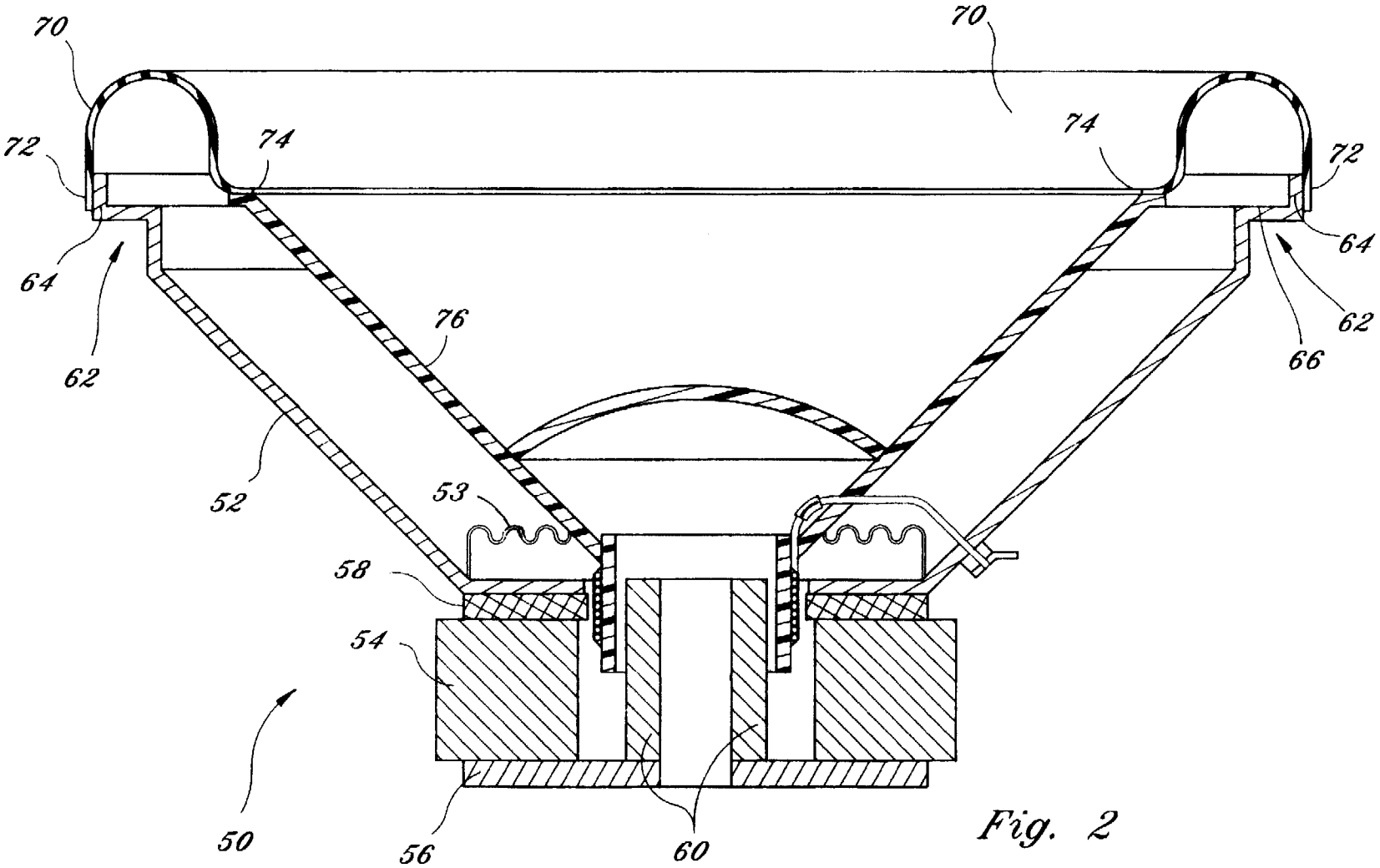
FIG. 2 is a side view of the present invention loudspeaker design.

FIG. 2 illustrates a similar view as FIG. 1, however, a loudspeaker 50 is shown incorporating some of the features of the present invention. Magnet 54, back plate 56 and top plate 58 remain and operate the same as like elements shown in FIG. 1. Loudspeaker 50 is also provided with a spider 53. However, as seen in FIG. 2, annular surround 70 is shown attached at its first outer peripheral or edge 72 to the outer peripheral or edge 64 of the mounting flange 62 of loudspeaker frame 52, instead of inner peripheral or edge 66. A second inner peripheral or edge 74 of annular surround 70 is shown attached to cone body or diaphragm 76 at its outer peripheral. Second edge 74 is attached to cone by conventional means such as adhesives. However, the attachment of first edge 72 to mounting flange 62 can be accomplished by several fixed and removable means. One fixed attachment mean would include the use of adhesives, which are in common use within the industry.

Preferably, edge 72 will be removably attached to outer edge 64 of annular mounting flange 62. Several of these removable attachment means will be illustrated and discussed below. However, it is to be understood that such fixed and removable attachment means, discussed herein, should not be considered exhaustive. Other attachment means, not shown, which will properly allow the first edge 72 of surround 70 to be attached to the outer edge 64 of mounting flange 62 are also within the scope of the present invention.

Figure 3A:
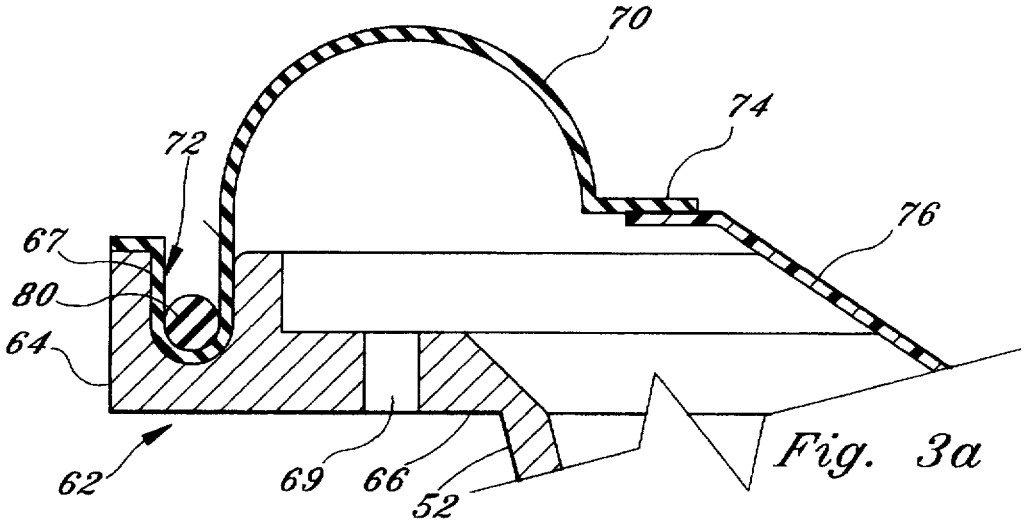
FIG. 3*a* is a cut away perspective view of a first removable surround to loudspeaker frame attachment embodiment of the present invention.

FIG. 3*a* illustrates a first embodiment for removably attaching outer or first edge 72 of annular surround 70 to the outside edge 64 of annular mounting flange 62 for loudspeaker frame 52. The second end 74 of surround 70 is shown conventionally attached to cone body 76. An annular groove 67 is formed at and around outside edge 64. A portion of edge 72 is shaped to conform to the shape of groove 67 and is disposed within groove 67. Once the relevant portion of edge 72 is disposed within groove 67, an annular o-ring 80 is pressure fitted within groove 67 and disposed over edge 72. Pressure fitted or elastic o-ring 80 maintains the attachment of edge 72 of surround 70 to outer edge 64 of mounting flange 62.

Access to mounting holes 69 of mounting flange 62 for loudspeaker frame 52 is achieved by removing pressure-fitted or elastic o-ring 80 and lifting surround 70 away, causing edge 72 to be withdrawn from groove 67 and ultimately exposing mounting holes 69. Once loudspeaker frame 52 has been securely mounted, by conventional means (not shown), edge 72 may be inserted or reinserted within groove 67 and o-ring 80 can be disposed to secure surround 70 to outer edge 64. Surround or roll 70 acts as an air-tight gasket when o-ring 80 is pressure fitted within groove 67. With this removable attachment embodiment of the present invention a relatively much larger portion of the loudspeaker's diameter is utilized, as compared to the prior art, when attaching surround 70.

Figure 3B:
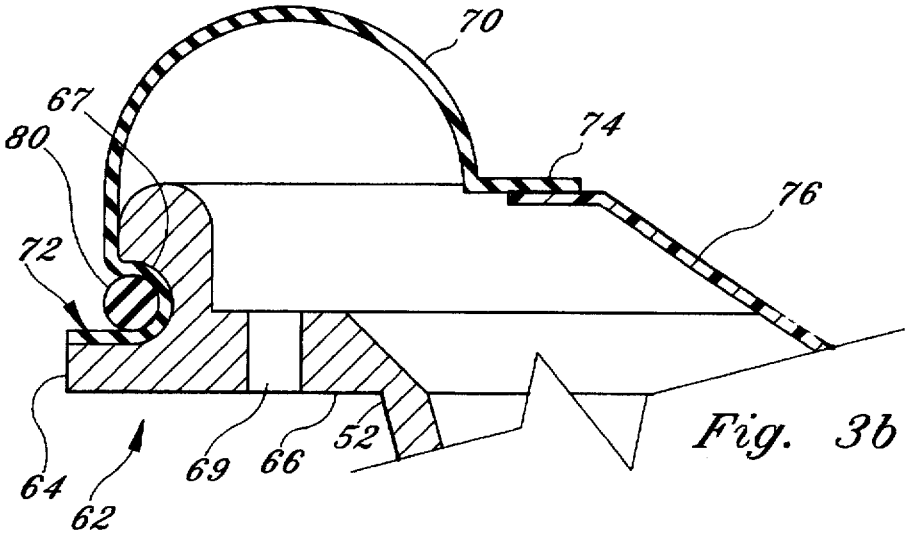
FIG. 3*b* is a cut away perspective view of a second removable surround to loudspeaker frame attachment embodiment of the present invention.

FIG. 3*b* illustrates the second embodiment which is the preferred embodiment for attaching outer edge 72 of annular surround 70 to the outside edge 64 of annular mounting flange 62 of loudspeaker frame 52. The second end 74 of surround 70 is shown conventionally attached to cone body 76. An annular groove 67 is formed at and around outside edge 64. A portion of edge 72 is shaped to conform to the shape of groove 67 and is disposed within groove 67. Once the relevant portion of edge 72 is disposed within groove 67, an annular o-ring 80 can be elastic or is pressure fitted within groove 67 and disposed over edge 72. Pressure fitted or elastic o-ring 80 maintains the attachment of edge 72 of surround 70 to outer edge 64 of mounting flange 62.

Access to mounting holes 69 of mounting flange 62 for loudspeaker frame 52 is again achieved by removing pressure-fitted o-ring 80 and lifting surround 70 away, causing edge 72 to be withdrawn from groove 67 and ultimately exposing mounting holes 69. Once loudspeaker frame 52 has been securely mounted by conventional means, edge 72 may be inserted or reinserted within groove 67 and o-ring 80 can be disposed to secure surround 70 to outer edge 64. Surround or roll 70 acts as an air-tight gasket when o-ring 80 is pressure fitted within groove 67. In this preferred embodiment, full use of loudspeaker 50's outside diameter is utilized.

Figure 3C:
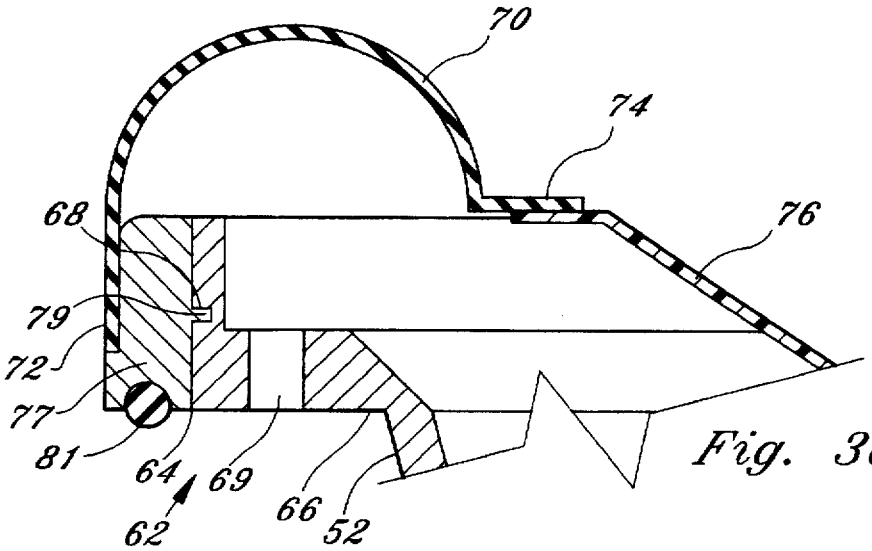
FIG. 3*c* is a cut away perspective view of a third removable surround to loudspeaker frame attachment embodiment of the present invention.
Figure 3D:
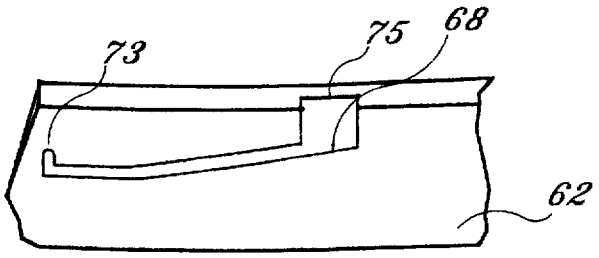
FIG. 3*d* is a front view illustrating the groove for the attachment embodiment of the present invention shown in FIG. 3*c;*
Figure 3E:
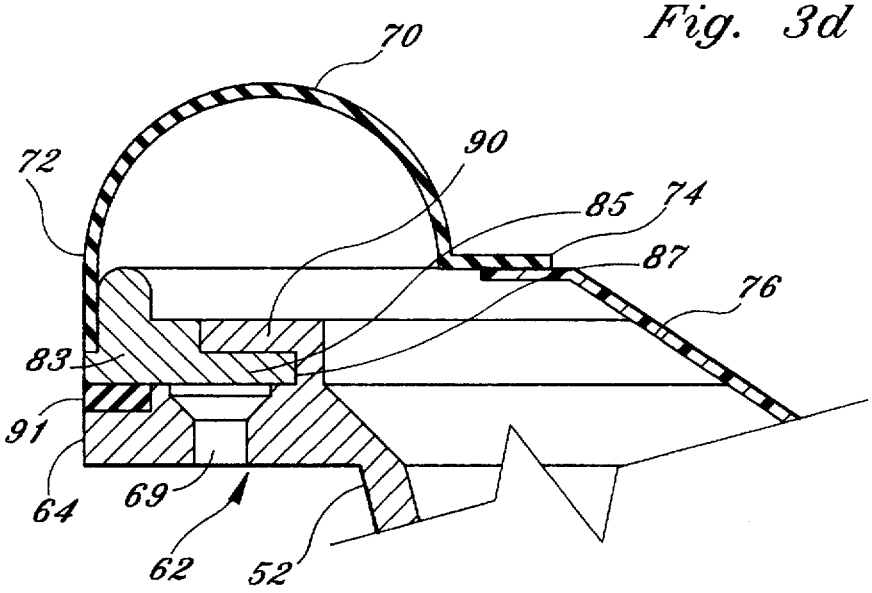
FIG. 3*e* is a cut away perspective view of a fourth removable surround to loudspeaker frame attachment embodiment of the present invention.
Figure 3F:
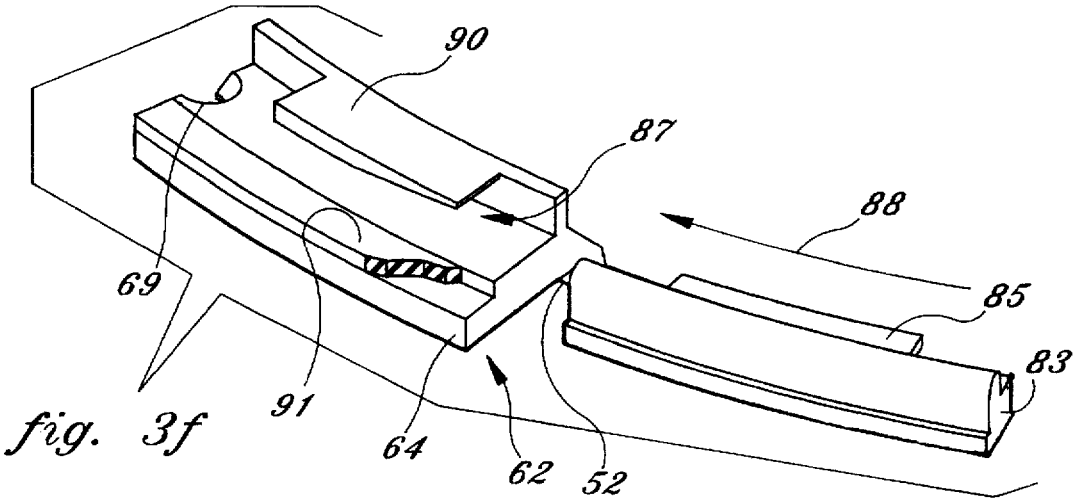
FIG. 3*f* is a perspective view illustrating the groove and locking member for the attachment embodiment of the present invention shown in FIG. 3*e;*
Figure 3G:
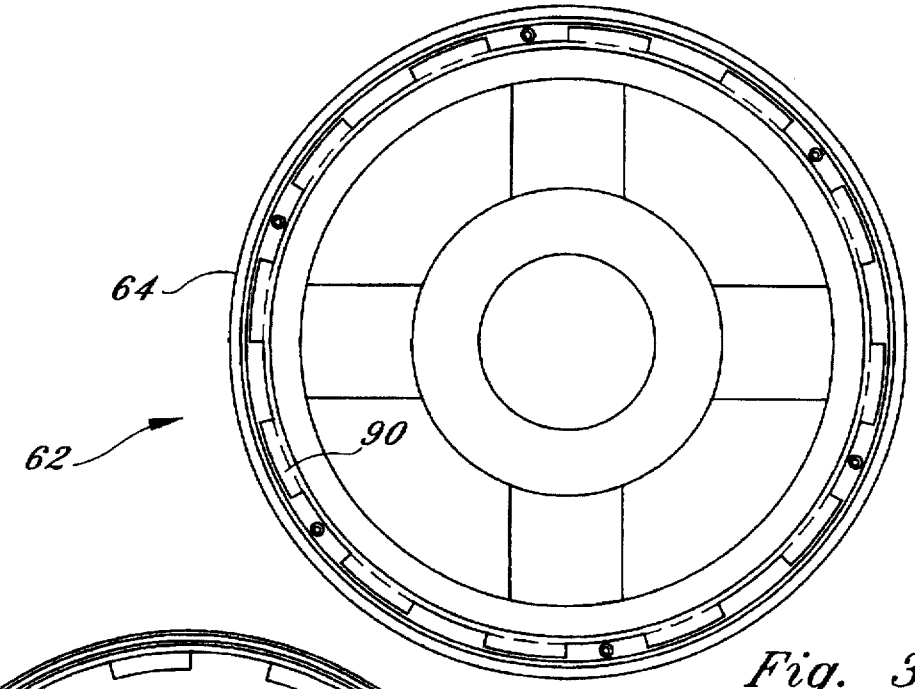
FIG. 3*g* is a top view illustrating the loudspeaker design of the invention shown in FIG. 3*e*, prior to the attachment of the locking member.
Figure 3H:
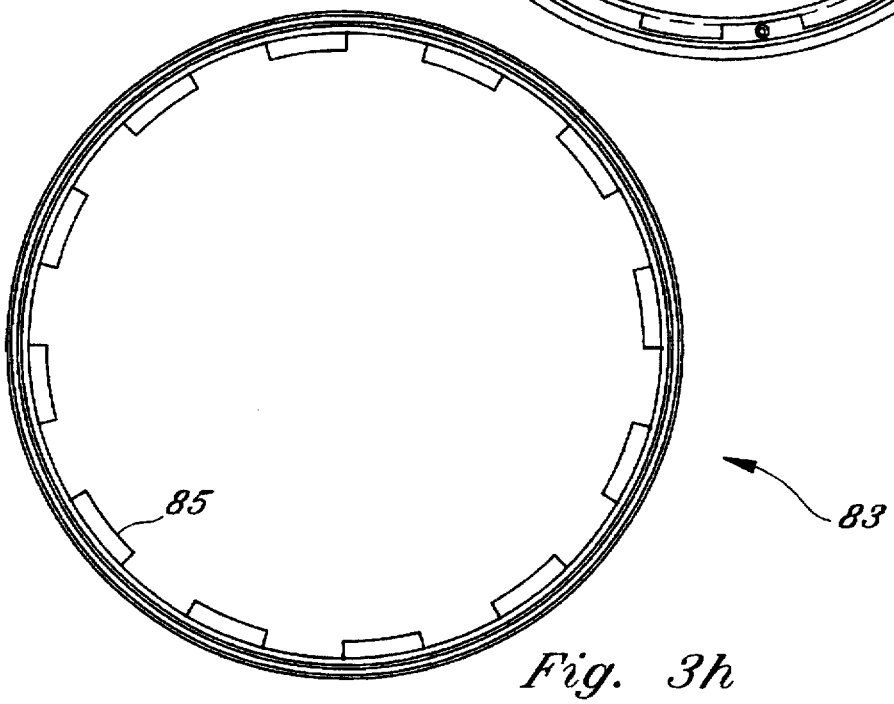
FIG. 3*h* is a top view illustrating the locking member of the invention shown in FIG. 3*e;*

FIGS. 3*c* and 3*d* illustrate a third embodiment for attaching outer edge 72 of annular surround 70 to outside edge 64 of annular mounting flange 62 for loudspeaker frame 52. In this embodiment, a member 77, hereinafter referred to as a male locking bayonet ring, is attached to outer edge 72. The second end 74 of surround 70 is shown conventionally attached to cone body 76. Preferably, male bayonet ring 77 is permanently attached to surround 70 by conventional means such as the application of adhesives. However, such is not limiting and other permanent or removable attachment designs for the attachment of surround outer edge 72 to bayonet ring 77 are within the scope of the present invention. Preferably, bayonet ring 77 is constructed from plastic. However, such is also not limiting and other materials may be utilized for the construction of bayonet ring 77.

Bayonet ring 77 is provided with a protrusion 79 of a predefined shape which mates with a groove 68 disposed within outside edge 64 of mounting flange 62. A ring 77 is provided, preferably, having a plurality of protrusions 79 associated therewith. Corresponding ring grooves 68 are disposed around and associated with surround 70 and loudspeaker frame 52, respectively. When attaching first edge 72 of surround 70 to loudspeaker frame 52, protrusion 79 is aligned at the open end 75 of groove 68. The twisting of cone body 76, in one direction, causes protrusion 79 to travel along groove 68 until it snaps and locks into place at a notched closed end 73 of groove 68, thus securely locking or attaching surround 70 to loudspeaker frame 52. Foam gasket 81 provides spring action, forcing and locking protrusion 79 into notch 73.

A twist of cone body 76, in the opposite direction, unsnaps protrusion 79 from end 73, allowing protrusion to travel the opposite direction along groove 68 towards and out of the open end 75 of groove 68, and ultimately causing the detachment of surround 70 from loudspeaker frame 52. In this embodiment, full use of loudspeaker 50's outside diameter is utilized.

Access to mounting holes 69 is achieved by removing protrusion 79 out of groove 68, which detaches surround 70 from mounting flange 62, thus allowing surround 70, ring 77 and gasket 81 to be lifted away from mounting flange 62 to expose mounting holes 69. Once loudspeaker frame 52 has been securely mounted by conventional means, protrusion 79 is inserted or reinserted within groove 68 and locked as described above, to secure surround 70 to outer edge 64, via bayonet ring 77.

In this embodiment, as the twisting of the cone body 76 is required to securely retain protrusion 79 within closed end 73 of groove 68, the spider stand off must also be removable, as will be fully discussed below. Accordingly, the whole front end of loudspeaker 50 must be removable with respect to this removable surround attachment embodiment. Additionally, the twisting of the front end properly into place, also causes the crushing of sealing o-ring 81 against mounting baffle (not shown), thus effecting a seal, not only between loudspeaker frame 52 and roll 70, but also between loudspeaker 50 and the loudspeaker enclosure or baffle (not shown). As such, this embodiment is preferably utilized with smooth mounting surfaces.

FIGS. 3*e*, 3*f*, 3*g* and 3*h* illustrate a fourth embodiment for attaching outer edge 72 of annular surround 70 to outside edge 64 of annular mounting flange 62 for loudspeaker frame 52. In this embodiment, a male locking member 83 is attached to outer edge 72. The second end 74 of surround 70 is shown conventionally attached to cone body 76, as with the other attachment embodiments of the present invention. Preferably, male locking member 83 is permanently attached to surround 70 by conventional means such as the application of adhesives. However, such is not limiting and other permanent or removable attachment designs between surround edge 72 and locking member 83 are within the scope of the present invention. Preferably, locking member 83 is constructed from plastic. However, such is also not limiting and other materials may be utilized for the construction of locking member 83.

Locking member 83 is provided with at least one, and preferably with a plurality of fingers 85 which mate with corresponding finger grooves 87 disposed within mounting flange 62. Locking fingers 85 and grooves 87 are disposed around and associated with surround 70 and loudspeaker frame 52, respectively. Groove 87 is defined by a top wall 90 and mounting flange 62 and is in communication with mounting hole 69 which is disposed within an adjacent portion of mounting flange 62. When attaching, first edge 72 of surround 70 is attached to locking member 83 and locking member 83 is attached to loudspeaker frame 52, by inserting locking finger 85 within groove 87. The twisting of cone body 76, in the direction of arrow 88, causes finger 85 to be properly locked within groove 87, thus securely locking or attaching surround 70 to loudspeaker frame 52. A twist of cone body 76, in the opposite direction, causes the detachment of surround 70 from loudspeaker frame 52. In this embodiment, full use of loudspeaker 50's outside diameter is utilized.

Access to mounting holes 69 is achieved by rotating roll 70, thus freeing locking fingers 85, to allow the front end to be completely removed, discussed below, or to allow surround 70 to be lifted away from mounting flange 62 to expose mounting holes 69. As with the third embodiment, the spider stand (not shown) must also be removable. However, unlike the third embodiment, this attachment design is not dependent on a smooth mounting surface.

In use, as the front end is twisted properly into place, compression gasket 91, preferably constructed from a foam material, effects a seal between roll 70 and basket or loudspeaker frame 52. With this embodiment, mounting holes 69 can be placed to the extreme outside edge of loudspeaker frame 52 for a better "bite" into the enclosure or baffle, as mounting screws (not shown) stay further away from the loudspeaker's mounting cut-out.

Thus, the present invention provides an improved surround 70 design for a loudspeaker 50 assembly wherein an outside edge 72 of surround 70 is attached to an outer edge of the loudspeaker's frame 52 via a permanent or removable means. When removably attached, access to the mounting holes 69 of the loudspeaker frame 52 is accomplished or provided by moving roll 70 to one side, prior to the attachment of the securing means. The method of attachment can vary, and in several embodiments includes the use of an annular o-ring 80, while in another attaching embodiment the use of a locking finger is provided.

The present invention provides for the improvement of overall volume displacement capability of loudspeaker 50 by allowing the use of the space typically reserved only for the loudspeaker's mounting flange 62, for larger or oversized surrounds 70 and/or greater cone area, thus allowing for increased volume displacement for any given loudspeaker diameter. Thus, for a given outside loudspeaker diameter and a given effective cone area, the present invention permits the use of a surround 70 with a much larger cross-sectional diameter, as compared to conventional designs. Because of the increased volume displacement capability, the present invention allows for the design of long-excursion loudspeakers which can outperform conventional loudspeakers of equal outside diameters using conventional surrounds.

The larger rolls or surrounds 70 also permit longer excursion, as compared to smaller rolls, with a lesser degree of roll deformation for a given excursion. Under high-excursion demands the larger rolls also provide a more consistent compliance and better cone centering ability.

Thus summarizing, by moving the outer attachment point of annular roll 70 to outside edge 64 of loudspeaker frame 52, a larger effective cone area is achieved for a given frame diameter (outside diameter). Thus, the design of smaller outside diameter loudspeakers with equal effective cone area as larger outside diameter conventional loudspeakers can be provided, without sacrificing the surround's roll diameter, which would affect the excursion capability. Furthermore, this embodiment of the present invention also permits increases in both cone area and excursion capability by providing a larger roll 70 and a larger cone area.

Furthermore, as stated above, the present invention allows the annular surround 70 to enclose the loudspeaker's mounting holes 69, thus achieving an excellent enclosure seal. The enclosure seal is important for the linear performance of enclosed low frequency systems. Also by enclosing loudspeaker's mounting holes 69, the mounting screws (not shown) are concealed which makes for a cleaner appearance.

Figure 3I:
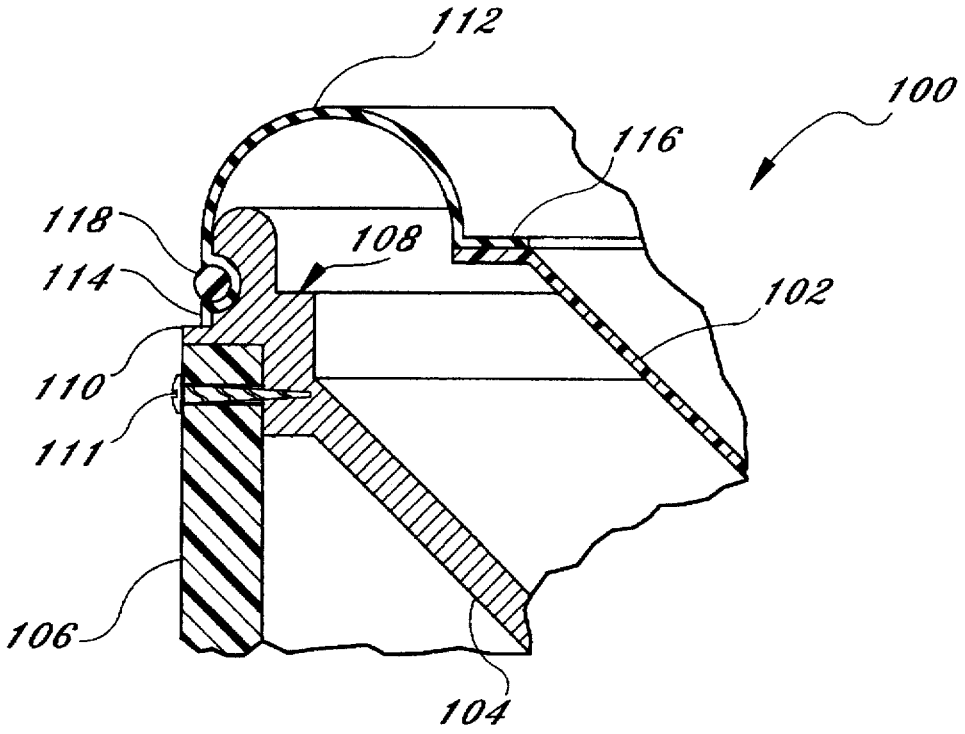
FIG. 3*i* is cut away section view of a surround to loudspeaker frame attachment embodiment of the present invention for use with "tube" (cylindrical) type loudspeaker systems.
Figure 3J:
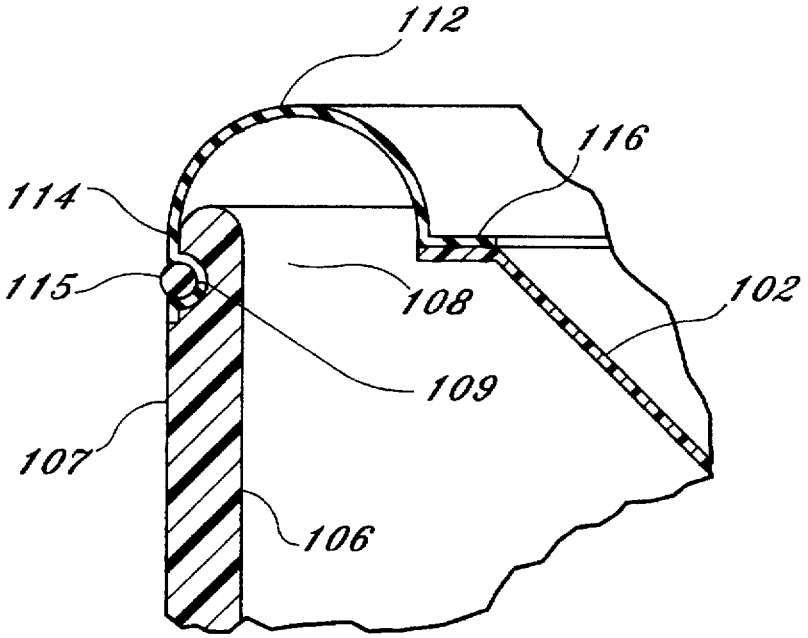
FIG. 3*j* is cut away perspective view of a surround to tube wall attachment embodiment of the present invention for use with "tube" (cylindrical) type loudspeaker systems.

FIGS. **3*i* and 3*j* illustrate alternative embodiments for attaching the annular surround in accordance with the teachings of the present invention (attaching over the loudspeaker frame) for "tube" type loudspeaker system applications. As seen in FIG. 3*i*, a first outer peripheral or edge 114 of annular surround 112 is shown removably attached to outer end 110 of annular mounting rim 108 for loudspeaker frame 104. A pressure-fitted or elastic annular o-ring 118 is disposed over edge 114, similar to the surround attachment embodiment, shown in 3*b*. Other surround attachment embodiments, discussed above, may also be utilized with "tube" type loudspeaker system 100. Access to the mounting holes (not shown) for attaching loudspeaker frame 104 to tube wall 106, is achieved by removing o-ring 118 and lifting surround 112, similarly to the removable attachment embodiments described above. Alternatively, surround 112 may be permanently attached to outer edge 110 of mounting flange 108, by conventional means such as adhesives. Loudspeaker frame 104 is then glued or pressure fitted into tube 106 or attached by a screw 111 disposed through tube 106**. However, such is not limiting, and other attachment embodiments are within the scope of the present invention.

Loudspeaker frame 104 is modified to fit within the inner diameter of tube wall 106, as well as being attached to tube wall 106. The second inner peripheral or edge 116 of annular surround 112 is shown conventionally attached to cone body 102 at its outer peripheral. This application of the present invention, with "tube" type loudspeaker systems, allows for maximization of cone area, increased roll linearity, and higher degrees of linear excursion. Furthermore, the removability and replaceability features of the present invention are available for "tube" type loudspeaker systems.

FIG. **3*j* illustrates a second embodiment of the present invention utilized with "tube" type loudspeaker systems. In this embodiment the loudspeaker frame normally associated with loudspeakers is removed. A first outer peripheral or edge 114 of annular surround 112 is shown removably attached to an annular outside surface 107 of tube wall 106. An annular groove 109 is formed within tube wall 106 and a adjacent portion of first edge 114 is shaped to allow insertion of the adjacent portion within groove 109 for attachment purposes. When attaching surround 112 to tube wall 106, after the adjacent portion of edge 114 is disposed within groove 109, a pressure-fitted or elastic annular o-ring 115 is disposed over the adjacent portion of edge 114 to provide removable attachment between surround 112 and tube wall 106. Other surround attachment embodiments, discussed above, may also be utilized. Alternatively, surround 112 may be permanently attached to tube wall 106** by conventional means such as the application of adhesives.

The second inner peripheral or edge 116 of annular surround 112 is shown conventionally attached to cone body 102 at its outer peripheral. This application of the present invention, with "tube" type loudspeaker systems, allows for maximization of cone area, increased roll linearity, and higher degrees of linear excursion, as well as improving the overall clearance for the moving parts. The elimination of the conventional loudspeaker frame provides reductions in costs as well as design complexity. Furthermore, the removability and replaceability features of the present invention are also available for "tube" type loudspeaker systems.

Figure 5:
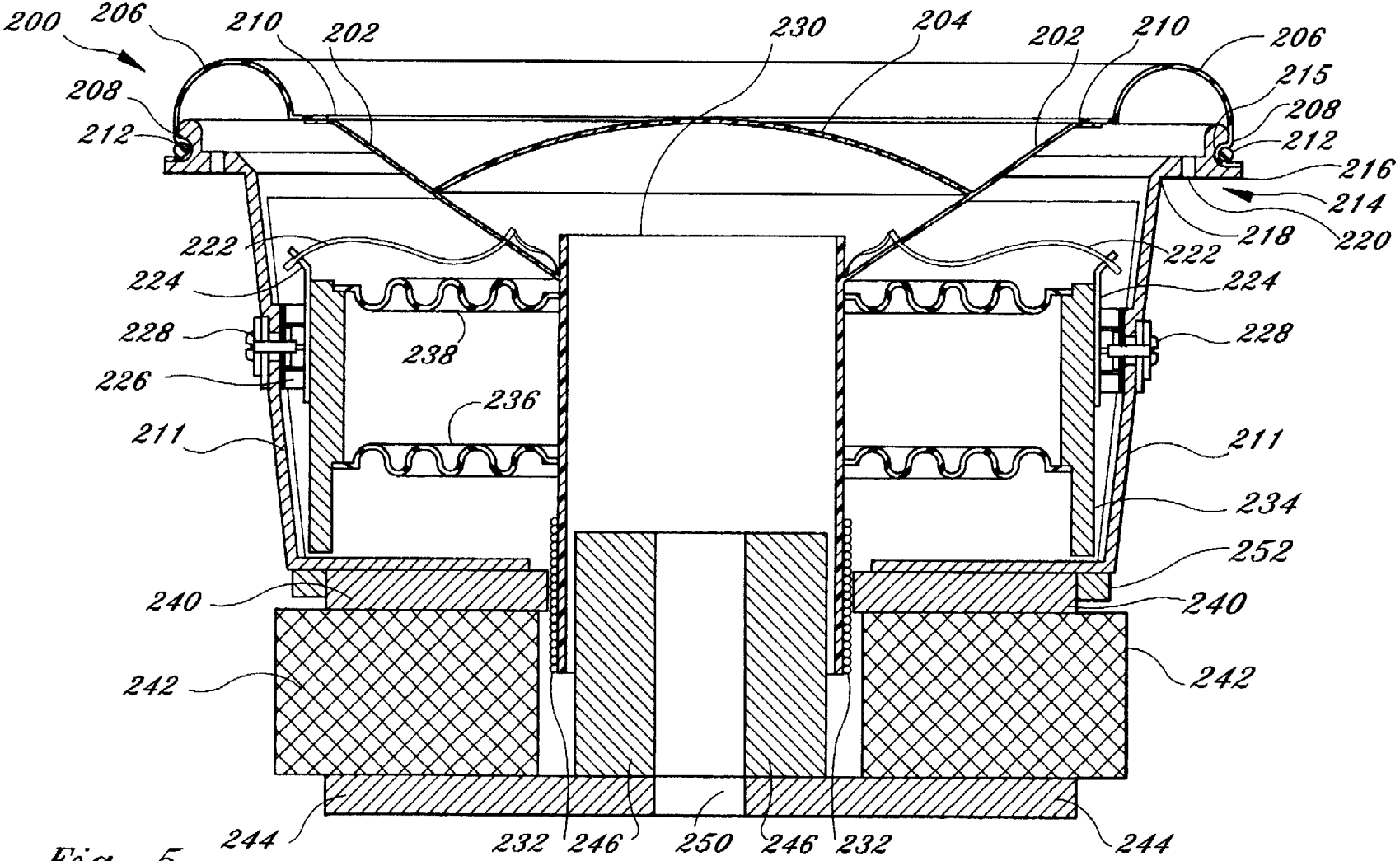
FIG. 5 is a cutaway sectional view of the present illustrating a removable surround and a removable spider to loudspeaker frame attachment.
Figure 6:
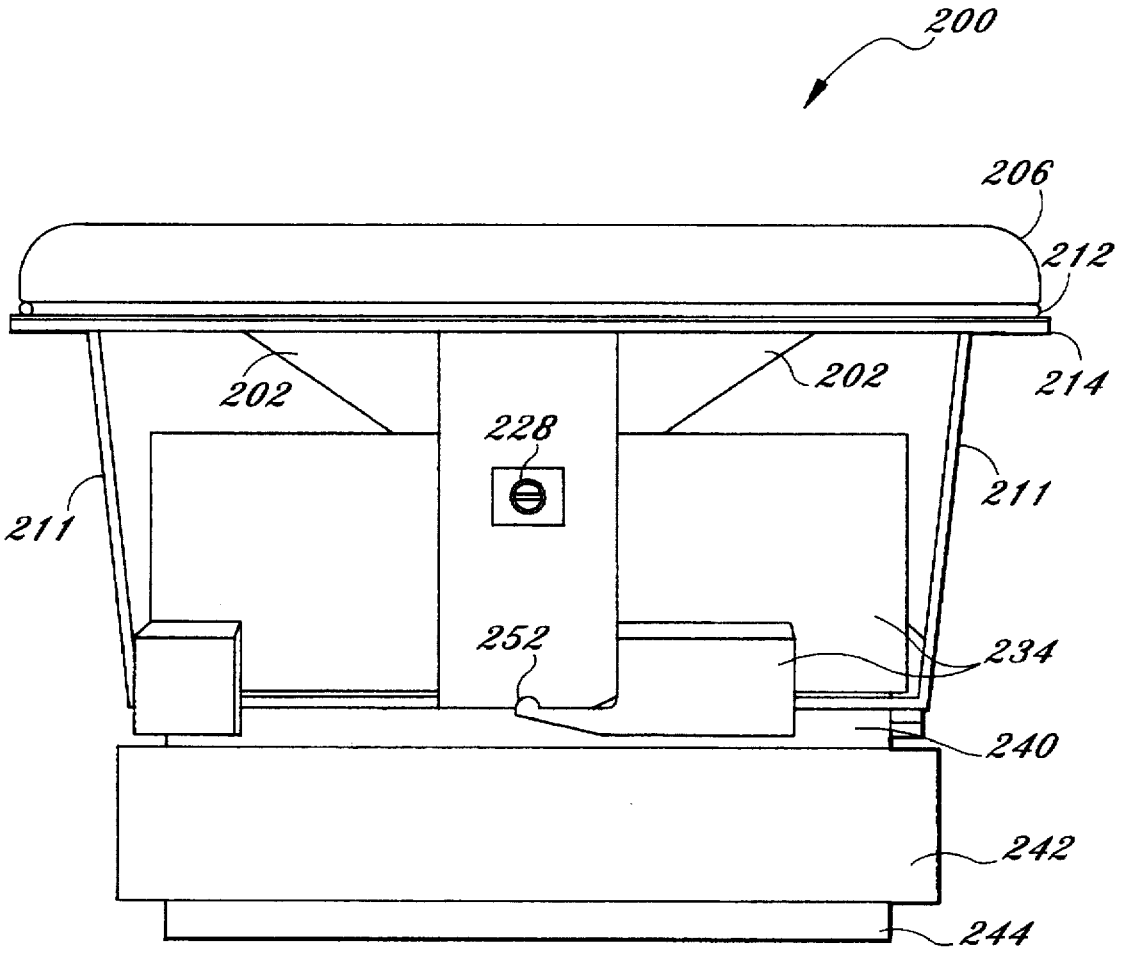
FIG. 6 is a side view of the present invention shown in FIG. 5 illustrating a removable spider and surround to loudspeaker frame attachment.

FIGS. 5 and 6 illustrate a loudspeaker 200 in accordance with the present invention, which incorporates the preferred embodiment for the removable surround attachment (FIG. **3*b*). However, it is to be understood that all of the other embodiments for the removable surround attachment, discussed above, as well as others, may be utilized with loudspeaker 200**.

Loudspeaker 200 comprises a "bowl" shaped loudspeaker frame or basket 211 with a permanent magnet 242 disposed between a top plate 240 and a back plate 244. Top plate 240 is attached to basket 211. A pole piece 246, in conjunction with top plate 240, define an air gap. A portion of voice coil windings 232, which are supported by a voice coil former 230, are disposed within the air gap and are carried by a diaphragm or cone body 202 for free axial movement in the air gap. Voice coil windings 232, voice coil former 230 and cone body 202 move in response to the resultant created by the dynamic interaction between the two magnetic fields, one coming from permanent magnet 242 and the other created by the signal voltage applied to voice coil windings 232. The input to voice coil 232 is amplified current. Actuation of diaphragm 202 generates pressure waves in the surrounding air which are perceived as sound.

Loudspeaker 200 is usually mounted on a gasket (not shown) surrounding an opening in a mounting board or "baffle", with an annular mounting flange or rim 214 of loudspeaker frame 211 being secured to the baffle (not shown) by mounting screws (not shown) which are inserted through mounting holes 220 of rim 214.

Cone body 202 is flexibly suspended by an annular collar or surround 206 which is removably secured at a first outer peripheral or edge 208 to the outer edge 216 of annular rim 214 and permanently secured at a second inner peripheral or edge 210 to cone body 202, at its outer peripheral, by conventional means such as the application of adhesives. Preferably, an annular groove 215 is provided around outer edge 216 of annular mounting flange 214, wherein a portion of first end 208 is shaped for insertion within groove 215, when attaching annular surround roll 206 to the outer edge 216. A pressure-fitted annular o-ring 212 is disposed over first end 208 adjacent groove 215, to removably attached surround 206 to outer edge 216 of mounting rim 214.

Access to the mounting screws (not shown) in accordance with the present invention is achieved by removing o-ring 212 and lifting surround 206 away to expose mounting holes 220. Another feature of the present invention is that the entire moving assembly (surround 206, cone body 202, dust cap 204, voice coil former 230, voice coil windings 232, lead wire 222, and contact striker plate 224, as well as a smooth contact point) of the loudspeaker 200 can be removed with a twist of cone body 202 for easier access to mounting holes 220.

Additionally, the moving assembly can also be removed for repair and/or replacement purposes, while permitting the fixed assembly (loudspeaker frame 211, top plate 240, magnet 242, back plate 244, pole piece 246, flexible metal contact strips 226, and electrical terminals 228) of loudspeaker 200 to remain attached to the baffle of the loudspeaker enclosure. Once loudspeaker frame 211 is securely mounted, the moving assembly can be twisted back into place and o-ring 212 can be reinserted to secure surround 206. Thus, the entire moving structure can be removed as a unit from the loudspeaker and easily reinstalled.

Locking fingers 252 (FIGS. 5 and 6) associated with spider stand-offs 234 firmly and removably secure the moving assembly with loudspeaker frame 211. When locking fingers 252 are properly disposed and secured underneath loudspeaker frame 211, spiders 236 and 238 and voice coil assembly 230 and 232 are caused to be properly aligned with respect to top plate 240. The outside diameter of top-plate 240 also functions as an alignment mechanism as the inner diameter of the bottom of spider standoff 234 fits exactly on the outer diameter of top-plate 240. Electrical contact is made via a series of flexible metal contact strips 226 which slide over the metal striker plates 224, as the front end or moving assembly of loudspeaker 200 is turned or locked into place.

Thus, by providing a removable attachment between surround 206 and loudspeaker frame 211, the present invention provides a method for quickly replacing the moving parts of a cone type loudspeaker 200, and in particular for loudspeaker's which feature a rear suspension or spider, such as spider 236 alone or in conjunction with spider 238, in addition to surround 206. To allow for the quick replacement feature of the present invention the following must be provided (1) a removable/replaceable surround 206 to loudspeaker frame 211 attachment, several embodiments of which have been discussed above; (2) a removable/replaceable spider 234, 236 and 238 to loudspeaker frame attachment, such as locking finger 252, which also ensures proper centering of the voice coil windings 232 in the magnetic gap; and (3) a removable/replaceable electrical contact for the voice coil circuit.

Accordingly, in view of the above, the present invention allows for moving parts replacement which is achieved without the use of adhesives, thus, eliminating adhesive-curing time and adhesive shelf-life problems, as well as the environmental impact of adhesives. The moving parts can be replaced without removing loudspeaker frame 211 from its mounting surface or enclosure. Thus, field service is greatly facilitated resulting in substantial time savings.

Figure 4A:
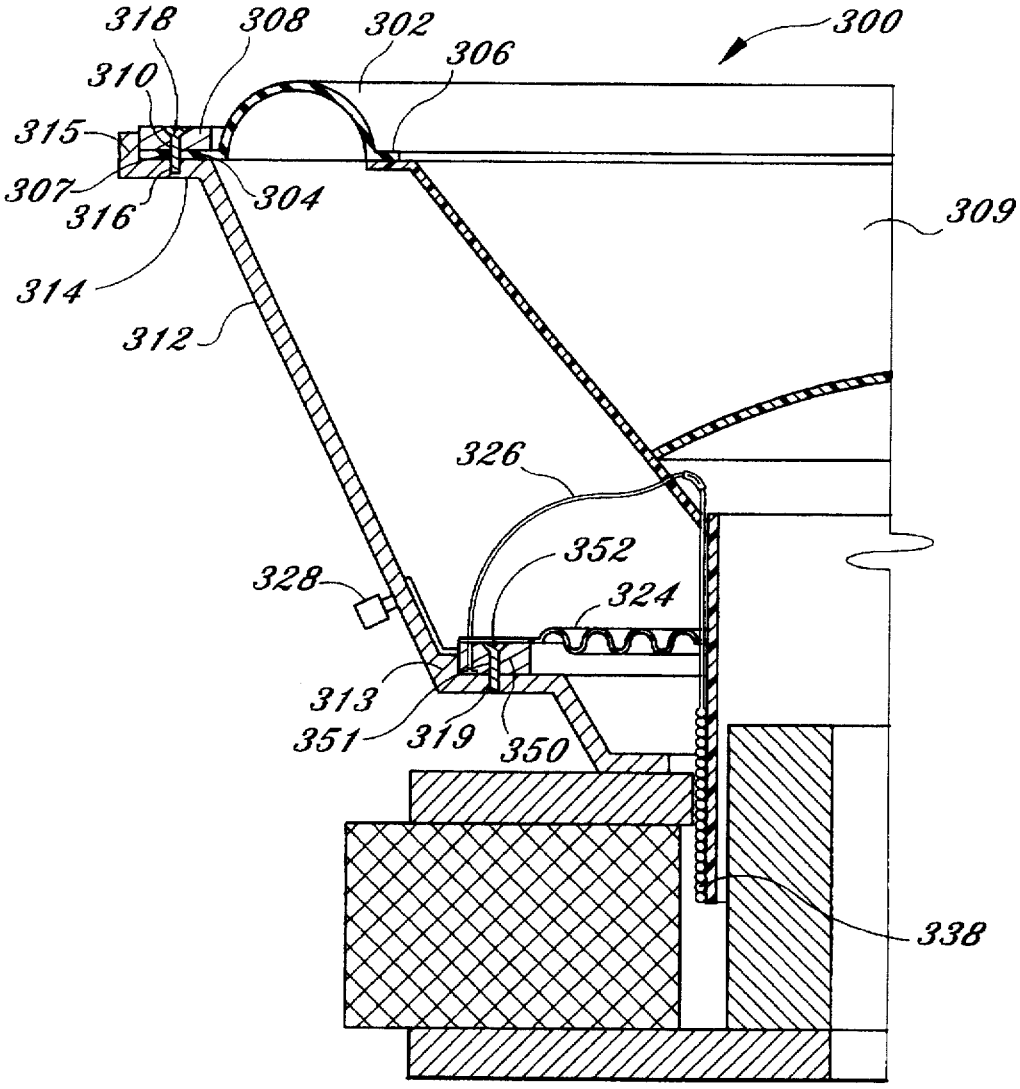
FIG. 4*a* is a side cutaway view of an alternative attachment embodiment for the surround and spider members of the present invention.
Figure 4B:
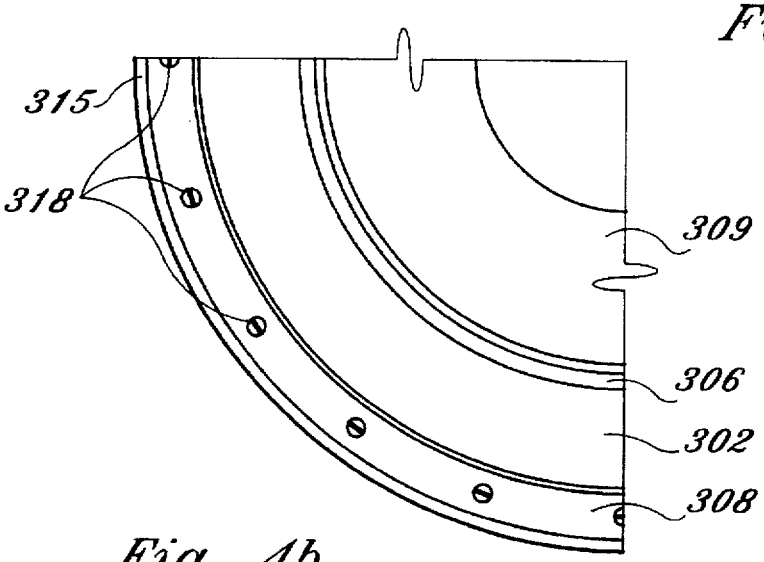
FIG. 4*b* is a top view of the invention shown in FIG. 4*a;*

FIGS. 4*a* and 4*b* illustrate an alternative embodiment for attaching an annular surround 302 to an annular mounting rim 314 of a loudspeaker frame 312, as well as providing for an alternative embodiment for removably attaching the front end of moving assembly of a loudspeaker 300.

To attach annular roll 302, a circular bracket 308, having a predetermined and precise outer diameter, is attached to the top surface of a first outer peripheral or edge 304 of roll 302 by conventional methods, such as adhesives. First edge 304 is provided with an aperture 307 extending therefore, which is aligned with an aperture 310 of roll bracket 308, when surround 302 is attached to bracket 308. Aperture 310 extends from the top surface to the bottom surface of roll bracket 308. A second end 306 is attached to the outer peripheral or edge of a cone body 309 by conventional means such as adhesives.

A raised outer edge or boss member 315 disposed at the edge of mounting flange 314 of loudspeaker frame 312 is provided whose inner diameter precisely mates with roll bracket 308. Roll bracket 308 slips inside raised outer edge 315 of loudspeaker frame 312. The mating relationship between boss member 315 and bracket 308 allows roll 302 to be centered and properly aligned within loudspeaker frame 312, while also aligning apertures 307 and 310 with a threaded recess 316 disposed within mounting flange 314.

Roll 302 and roll bracket 308 are attached to loudspeaker frame 312, via machine screws 318, inserted in apertures 307 and 310 and threaded recess 316. However, such attachment means is not limiting, and other conventional methods may be utilized for attaching roll 302 to mounting flange 314. Apertures 307 and 310 may also be threaded.

Mounting flange 314 is also provided with conventional mounting holes (not shown) for attaching loudspeaker frame 312 to a baffle or loudspeaker enclosure (not shown), thus allowing loudspeaker frame 312 to remain attached to the enclosure, while the moving assembly is removed. In lieu of the mounting holes, threaded recess 316 can extend through mounting flange 314 and also act as mounting holes. Thus, machine screws 318 would serve the dual function of attaching roll 302 and roll bracket 308 to loudspeaker frame 312 while also serving as the attachment means for securing loudspeaker frame 312 to the baffle or loudspeaker enclosure. However, where threaded recess 316 serves this dual purpose, the fixed assembly of loudspeaker 300 may also be removed from the loudspeaker box or remain loose within the loudspeaker box, in addition to the moving assembly, when repairing or replacing the moving assembly in accordance with the present invention.

Spider 324 is attached to loudspeaker frame 312 in a similar fashion as the attachment of roll 302 to mounting flange 314. To attach spider 324, a circular bracket 350, having a predetermined and precise outer diameter, is attached to spider 324 by conventional methods, such as adhesives. An aperture 351 extends from the top surface to the bottom surface of spider bracket 350.

A matching boss member 313 disposed at the lower plateau of loudspeaker frame 312 is provided whose inner diameter precisely mates with spider bracket 350. Spider bracket 350 slips inside boss member 313 of loudspeaker frame 312. The mating relationship between boss member 313 and bracket 350 ensures proper alignment of the voice coil 338 within the magnetic gap, while also aligning aperture 351 with a threaded recess 319 disposed within loudspeaker frame 312. Spider bracket 350 is attached to loudspeaker frame 312, via machine screws 352, inserted in aperture 351 and threaded recess 319. Aperture 351 may also be threaded.

Lead wire 326 is attached to spider bracket 350. Spring clips 321 (not shown) are used with loudspeaker frame 312 and spider bracket 350 to facilitate lead wire 326 contact to outer loudspeaker electrical terminals 328.

The removal of the moving structure of loudspeaker 300 could also be achieved via a combination of a screw down roll bracket, such as bracket 308, and a bayonet style spider bracket, similar in concept to that shown in FIG. 3*c*. Alternatively, a bayonet style roll and screwdown spider may also be utilized.

A relative amount of convenience is lost with this embodiment, as the loudspeaker may have to be removed from its enclosure and tools are required for removal of the moving assembly. However, the same ultimate results are obtainable (a removable front end assembly), though requiring a relatively longer time period to obtain such results. Accordingly, this alternative embodiment allows for field repairs by consumers and the availability of replaceable parts packages for changing the driver's specifications (and ultimately its operating environment).

The alternative embodiment shown in FIGS. 4*a* and 4*b* provide a removable and replaceable surround 302 to loudspeaker frame 312 attachment, as well as a removable and replaceable attachment of spider 324 to loudspeaker frame 312, thus, ensuring proper centering of voice coil 338 in the magnetic gap. Also provided is a removable and replaceable electrical contact for the voice coil circuit. The alternative embodiment fails to provide the relatively quick repair or replacement feature of the removable front end assemblies discussed above, as tools are required by the user for removing the front end assembly.

In all embodiments of the present invention, an oversized surround or roll may be provided. However, the present invention may be utilized and constructed with conventional surrounds typically used in loudspeaker applications.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A loudspeaker comprising the combination of a frame having a surround attachment area; a cone assembly which includes a cone body having an outer periphery; a flexible annular surround connecting the cone body to the frame, the surround attachment area of said frame having an outermost portion, said surround having an inner peripheral edge secured to the cone body and an outer peripheral edge secured to the outermost portion of the surround attachment area; and means for removably attaching said surround to the outermost portion of the surround attachment area;

wherein said frame including a plurality of mounting holes and said means for removably attaching includes a ring member attached to the outer peripheral of said surround, said ring member having at least one protrusion for mating with at least one groove disposed within said surround attachment area, wherein the twisting of the cone body in a certain direction causes said protrusion to lock into place within said at least one groove thus removably attaching said surround to said surround attachment area, wherein access to the mounting holes is achieved by twisting the cone body in an opposite direction thus releasing said at least one protrusion from said at least one groove and allowing said surround to be lifted away from said frame to expose the mounting holes.

2. The loudspeaker of claim 1 further including a second means for removably attaching a lower end of said cone assembly to said frame.

3. The loudspeaker of claim 2 wherein said second means for removably attaching including a spider member attached to the lower end of said cone body, said spider member including a bracket member having at least one locking finger for mating with a lower end of said frame, wherein said surround, cone body and spider member may be removed from said frame member for repair or replacement purposes.

4. The loudspeaker of claim 2 wherein a lower area of said frame is provided with a recess, wherein said second means for removably attaching including a spider member attached to the lower end of said cone body, a bracket member attached to said spider member, said bracket member having an aperture extending therethrough from a top surface to a bottom surface, wherein said bracket member is disposed within the lower area of said frame such that said bracket aperture is aligned and communicating with said recess to allow for the insertion of a mounting member within said bracket aperture and threaded recess to removably attached said lower end of said cone body to said frame.

5. The loudspeaker of claim 4 wherein said mounting member is a mounting screw and said recess is threaded.

6. The loudspeaker of claim 5 wherein said second means for removably attaching further includes a boss member attached to the lower area of said frame, wherein when said bracket member is disposed within said lower area of said frame, said boss member ensures proper alignment of said cone body.

7. A loudspeaker comprising the combination of a frame having a surround attachment area; a cone assembly which includes a cone body having an outer periphery; a flexible annular surround connecting the cone body to the frame, the surround attachment area of said frame having an outermost portion, said surround having an inner peripheral edge secured to the cone body and an outer peripheral edge secured to the outermost portion of the surround attachment area; and means for removably attaching said surround to the outermost portion of the surround attachment area;

wherein said frame including a plurality of mounting holes and said means for removably attaching includes a locking member attached to the outer peripheral of said surround, said locking member having at least one locking finger for mating with at least one corresponding groove disposed within said surround attachment area, wherein the twisting of the cone body in a certain direction causes said at least one locking finger to lock into place within said at least one groove thus removably attaching said surround to said surround attachment area, wherein access to the mounting holes is achieved by twisting the cone body in an opposite direction thus releasing said at least one locking finger from said at least one groove and allowing said surround to be lifted away from said frame to expose the mounting holes.

8. A loudspeaker comprising:

a diaphragm having a voice coil and an integral edge:

a frame member for supporting said diaphragm, said frame member having a surround attachment area;

a surround removably attached at its outer periphery to an outermost portion of said surround attachment area, said surround attached at its inner edge to the diaphragm at the integral edge;

a driver unit for driving said diaphragm, said driver unit connected to the frame member, said driver unit including electrical means for providing an electrical impulse to the voice coil and moving the voice coil within a magnetic field produced by said driver unit to move said diaphragm and produce an audible sound; and means for removably attaching said surround to the outermost portion of the surround attachment area;

wherein said frame including a plurality of mounting holes and said means for removably attaching includes a ring member attached to the outer peripheral of said surround, said ring member having at least one protrusion for mating with at least one groove disposed within said surround attachment area, wherein the twisting of the cone body in a certain direction causes said protrusion to lock into place within said at least one groove thus removably attaching said surround to said surround attachment area, wherein access to the mounting holes is achieved by twisting the cone body in an opposite direction thus releasing said at least one protrusion from said at least one groove and allowing said surround to be lifted away from said frame to expose the mounting holes.

9. A loudspeaker comprising:

a diaphragm having a voice coil and an integral edge:

a frame member for supporting said diaphragm, said frame member having a surround attachment area;

a surround removably attached at its outer periphery to an outermost portion of said surround attachment area, said surround attached at its inner edge to the diaphragm at the integral edge;

a driver unit for driving said diaphragm, said driver unit connected to the frame member, said driver unit including electrical means for providing an electrical impulse to the voice coil and moving the voice coil within a magnetic field produced by said driver unit to move said diaphragm and produce an audible sound; and means for removably attaching said surround to the outermost portion of the surround attachment area;

wherein said frame including a plurality of mounting holes and said means for removably attaching includes a locking member attached to the outer peripheral of said surround, said locking member having at least one locking finger for mating with at least one corresponding groove disposed within said surround attachment area, wherein the twisting of the cone body in a certain direction causes said at least one locking finger to lock into place within said at least one groove thus removably attaching said surround to said surround attachment area, wherein access to the mounting holes is achieved by twisting the cone body in an opposite direction thus releasing said at least one locking finger from said at least one groove and allowing said surround to be lifted away from said frame to expose the mounting holes.

* * * * *